US010448693B2

(12) United States Patent
Noordzij et al.

(10) Patent No.: US 10,448,693 B2
(45) Date of Patent: Oct. 22, 2019

(54) HELMET MOUNTED VISOR

(71) Applicant: Artisent, LLC, Simpson, PA (US)

(72) Inventors: Duco W. Noordzij, Roslindale, MA (US); Nathan E. Winters, Merrimack, NH (US); Matthew Anthony Hanudel, Waltham, MA (US)

(73) Assignee: GENTEX CORPORATION, Simpson, PA (US)

( * ) Notice: Subject to any disclaimer, the term of this patent is extended or adjusted under 35 U.S.C. 154(b) by 109 days.

(21) Appl. No.: 15/517,174

(22) PCT Filed: Oct. 8, 2015

(86) PCT No.: PCT/US2015/054687

§ 371 (c)(1),
(2) Date: Apr. 6, 2017

(87) PCT Pub. No.: WO2016/057792

PCT Pub. Date: Apr. 14, 2016

(65) Prior Publication Data

US 2017/0325534 A1 Nov. 16, 2017

Related U.S. Application Data

(60) Provisional application No. 62/061,823, filed on Oct. 9, 2014.

(51) Int. Cl.
*A42B 3/22* (2006.01)

(52) U.S. Cl.
CPC ..... *A42B 3/225* (2013.01); *A42B 3/222* (2013.01); *A42B 3/223* (2013.01)

(58) Field of Classification Search
CPC ... A42G 83/225; A42G 83/222; A42G 83/223
(Continued)

(56) References Cited

U.S. PATENT DOCUMENTS 2,433,164 A * 12/1947 Shields ..... A61F 9/06 2/8.1
4,907,300 A * 3/1990 Dampney ..... A42B 3/228 2/424

(Continued)

FOREIGN PATENT DOCUMENTS

EP 0205545 A1 12/1986
GB 1561597 A 2/1980

(Continued)

OTHER PUBLICATIONS

Extended European Search Report dated Apr. 19, 2018 for European Patent Application No. 15848550.8, 7 pages.

(Continued)

*Primary Examiner* — Gloria M Hale
(74) *Attorney, Agent, or Firm* — Morgan, Lewis & Bockius LLP

(57) ABSTRACT

A helmet mounted visor includes a lens that may be configured to extend across substantially all of a user's face. The helmet mounted visor may include a pair of mount arms coupled to the lens and each configured to releaseably mount to a mount attached to a helmet. The pair of mount arms may each including first, second and third portions. The first portion may be rotatably coupled to the second portion about a first axis. The first portion may be rotatably coupled to the third portion about a second axis. The second axis may be generally perpendicular to the first axis. A locking mechanism may be provided and configured to selectively retain the first portion relative to the second portion in and between a use position where the lens is positioned in front of the user's face and a stowage position where the lens is positioned proximate the top of the helmet.

18 Claims, 16 Drawing Sheets

(58) Field of Classification Search
USPC ..... 2/424
See application file for complete search history.

(56) References Cited

U.S. PATENT DOCUMENTS

| | | | | |
|---|---|---|---|---|
| 5,581,806 | A * | 12/1996 | Capdepuy | A42B 3/04 2/422 |
| 5,832,566 | A * | 11/1998 | Quek | G06F 1/1616 16/342 |
| 5,966,738 | A | 10/1999 | Want | |
| 6,041,435 | A | 3/2000 | Paulson et al. | |
| 7,849,517 | B2 | 12/2010 | Rogers et al. | |
| 2008/0092278 | A1 * | 4/2008 | Rogers | A42B 3/04 2/422 |
| 2012/0246807 | A1 | 10/2012 | Klotz et al. | |
| 2013/0021278 | A1 * | 1/2013 | Landau | G06F 3/044 345/173 |
| 2013/0212787 | A1 | 8/2013 | Pfanner et al. | |

FOREIGN PATENT DOCUMENTS

| | | | |
|---|---|---|---|
| JP | S6373323 | U | 5/1988 |
| WO | 2014/186682 | A1 | 11/2014 |

OTHER PUBLICATIONS

International Search Report dated Jan. 28, 2016 for International Patent Application No. PCT/US2015/054687.
Written Opinion dated Jan. 28, 2016 for International Patent Application No. PCT/US2015/054687.
Examination Report dated Jan. 17, 2019 for European Patent Application No. 15848550.8, 2 pages.

* cited by examiner

HELMET MOUNTED VISOR

CROSS-REFERENCE TO RELATED APPLICATIONS

This application is a U.S. National Stage of International Patent Application No. PCT/US2015/054687, filed Oct. 8, 2015, which claims the benefit of U.S. Provisional Patent Application No. 62/061,823 filed Oct. 9, 2014 entitled "Helmet Mounted Visor", each of which is incorporated by reference herein in its entirety.

FIELD OF THE INVENTION

The present invention generally relates to a helmet mounted visor. In some embodiments, the helmet mounted visor is a ballistic ocular shield that removeably mounts to a ballistic helmet.

BRIEF SUMMARY OF THE INVENTION

In one embodiment there is a helmet mounted visor comprising a lens configured to extend across substantially all of a user's face; and a pair of mount arms coupled to the lens and each configured to releaseably mount to a mount attached to a helmet. In one embodiment, the pair of mount arms each include first and second portions, the first portion being rotatably coupled to the second portion. In one embodiment, the first portion is configured to be rotated between and held in two or more positions relative to the second portion. In one embodiment, the two or more positions include a use position where the lens is positioned in front of the user's face and a stowage position where the lens is positioned over a top surface of the helmet. In one embodiment, the two or more positions include a middle position where the lens is positioned between the use position and the stowage position. In one embodiment, at least one of the pair of mount arms includes a locking mechanism configured to lock the first portion relative to the second portion. In one embodiment, the locking mechanism includes a drum brake. In one embodiment, the locking mechanism includes a lever configured to selectively lock and release the drum brake.

In one embodiment, the first portion is rotatable relative to the second portion about a first axis and the pair of mount arms each include a third portion, the first portion being rotatably coupled to the third portion about a second axis, the second axis being generally perpendicular to the first axis. In one embodiment, the mount is a rail. In one embodiment, the rail is attached to the helmet using fasteners that extend through existing holes in the helmet. In one embodiment, the pair of mount arms each include a projection configured to attach to a groove in the mount in a plurality of positions along the groove. In one embodiment, a position of the projections are adjustable relative to the pair of mount arms. In one embodiment, the lens has a thickness of at least approximately 28 mm. In one embodiment, the lens has a height of at least approximately 127 mm. In one embodiment, the mount arms are configured to mount to the helmet to position the lens at a plurality of distances from the user's face. In one embodiment, a flange is mounted to the top of the lens and extends toward the mount arms.

In another embodiment there is a helmet mounted visor comprising: a lens; a pair of mount arms coupled to the lens and each configured to releaseably mount to a mount attached to a helmet, the pair of mount arms each including first, second and third portions, the first portion being rotatably coupled to the second portion about a first axis, the first portion being rotatably coupled to the third portion about a second axis, the second axis being generally perpendicular to the first axis; and a locking mechanism configured to selectively retain the first portion relative to the second portion in and between a use position where the lens is positioned in front of a user's face and a stowage position where the lens is positioned proximate a top of the helmet.

BRIEF DESCRIPTION OF THE SEVERAL VIEWS OF THE DRAWINGS

The following detailed description of embodiments of the helmet mounted visor will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1:
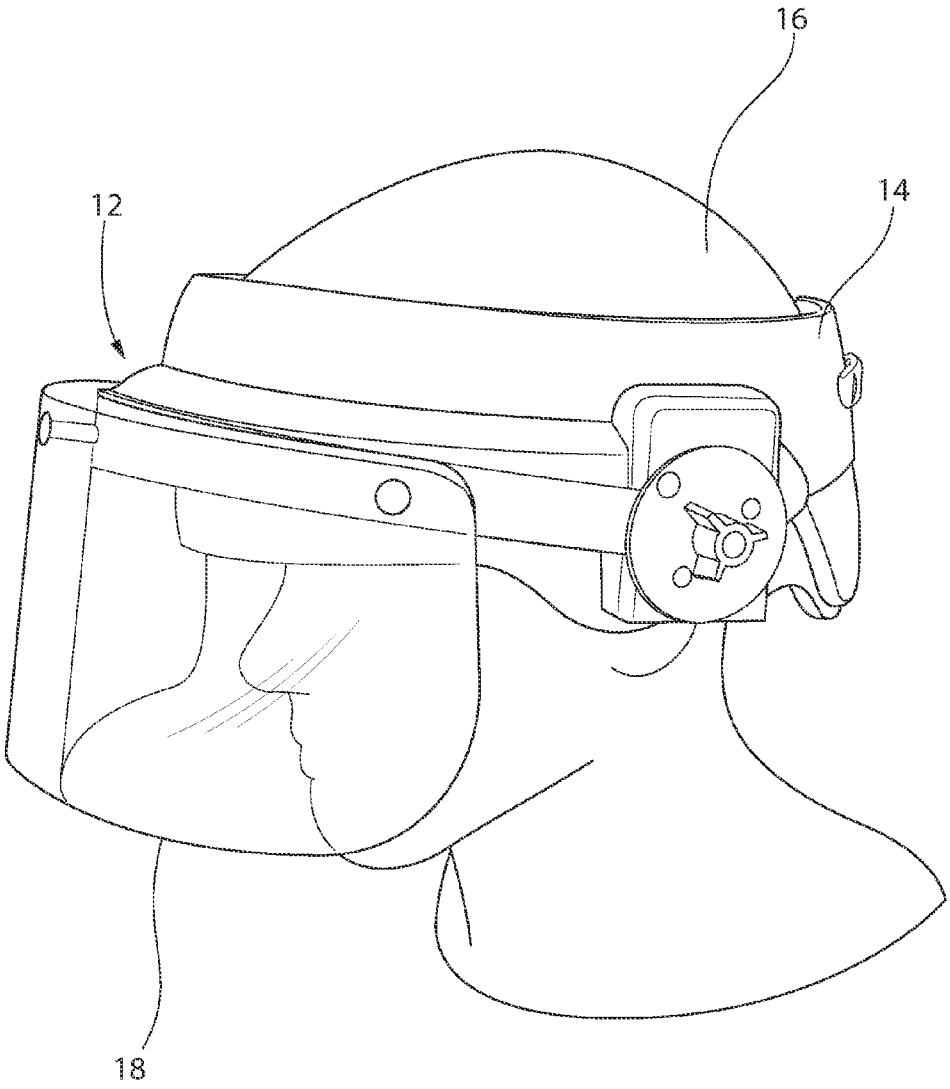
FIG. 1 Prior Art
FIG. 1 is a perspective view of a helmet mounted visor and mounting halo as known in the prior art shown mounted to a helmet.

Referring to FIG. 1, a helmet mounted visor 12, also referred to as ballistic ocular shield or 9 mm ballistic face shield, is designed to protect a user's face and eyes from ballistic projectiles and other objects. In some instances, the helmet mounted visor 12 includes a lens 18 designed to protect a user's face and eyes from a 9 mm, 124 grain full metal jacket (FMJ) projectile. The lens 18 may be designed to protect a user's face from other projectiles such as a 10.9 mm ("44 Mag") projectile. The lens 18 may provide ballistic protection levels of V0 1400 feet per second (FPS), level MA velocity or V0 1175 FPS, level II Velocity. The level III A version may also defeat with no penetration V0 the 17 grain fragmentation simulator at a minimum velocity of 2000 FPS. The V0 1400 feet per second lens weighs approximately 54.2 ounces and the V0 1175 feet per second lens weighs approximately 44.7 ounces.

The helmet mounted visor 12 attaches to a helmet 16. Traditional helmet mounted visors 12 attach to the helmet 16 via a very bulky "halo" system 14 which includes a plastic band that wraps around the helmet 16 and is secured to the helmet 16 via a ratcheting band. The halo system 14 does not fit one helmet to the next consistently. Additionally, any mounts such as shrouds and rails must be removed from the helmet 16 before using the halo system 14 which may take time and defeat the ability of the mounts to provide additional helmet utility.

Referring to the drawings in detail, wherein like reference numerals indicate like elements throughout, there is shown in FIGS. 2-8 a helmet mounted visor, generally designated 10, in accordance with a first exemplary embodiment of the present invention.

Figure 3:
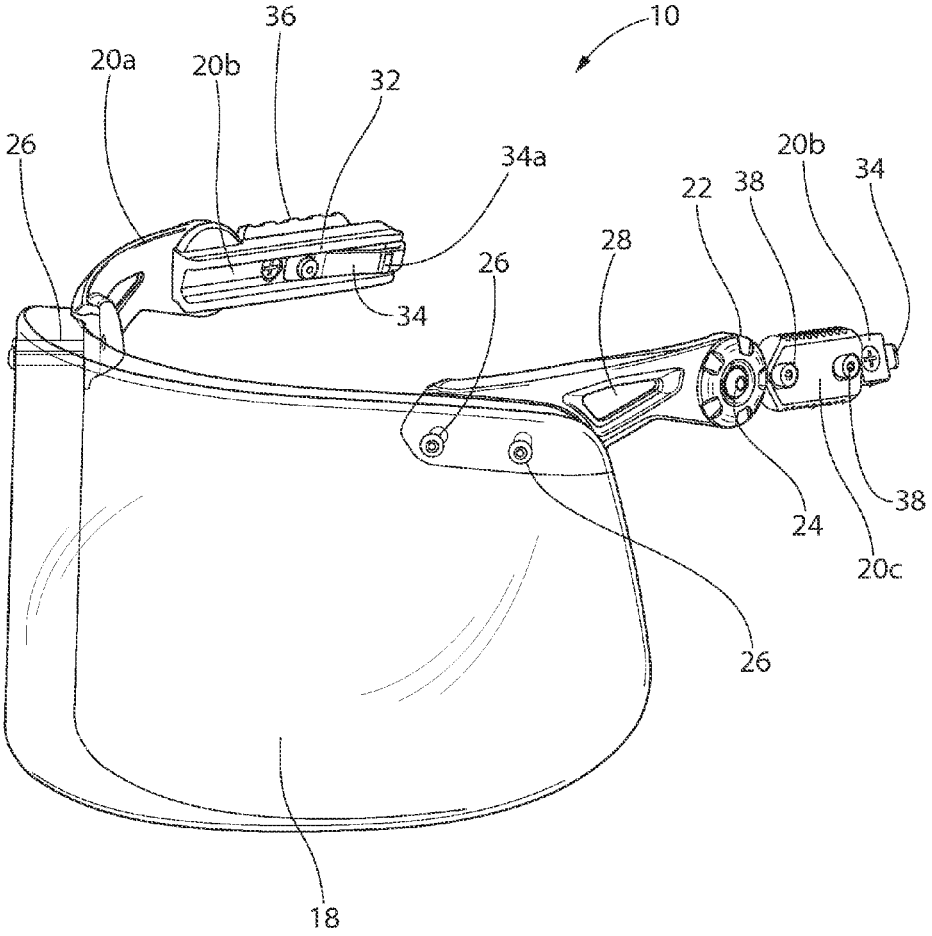
FIG. 3 is a perspective view of the helmet mounted visor shown in FIG. 2.

Referring to FIG. 3, the helmet mounted visor 10 includes a lens 18. In one embodiment, the lens 18 is configured to extend across substantially all of a user's face. In one embodiment, the lens 18 is curved to extend across the front and sides of the user's face. The lens 18 may be transparent. In other embodiments, the lens 18 has a tint. The lens 18 may be frameless. In other embodiments, the lens 18 may include a frame extending around at least a portion of the outer periphery. In one embodiment, the lens 18 is approximately 28 mm thick, 280 mm wide and 127 mm high. In one embodiment, the lens 18 is approximately 150 mm or approximately 178 mm high. In one embodiment, the lens 18 is comprised of a ballistic material such as a polycarbonate substrate with an acrylic laminate.

Figure 2:
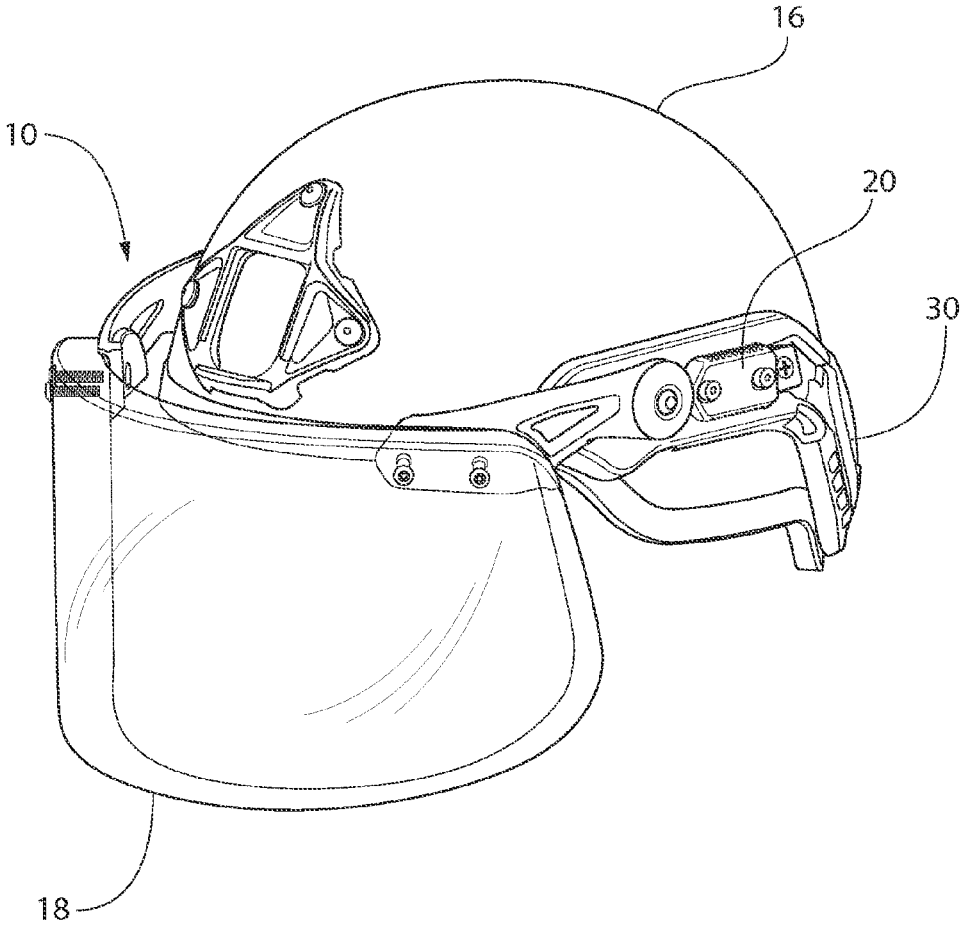
FIG. 2 is a perspective view of a helmet mounted visor in accordance with an exemplary embodiment of the present invention shown mounted to a helmet and in the use position.
Figure 7:
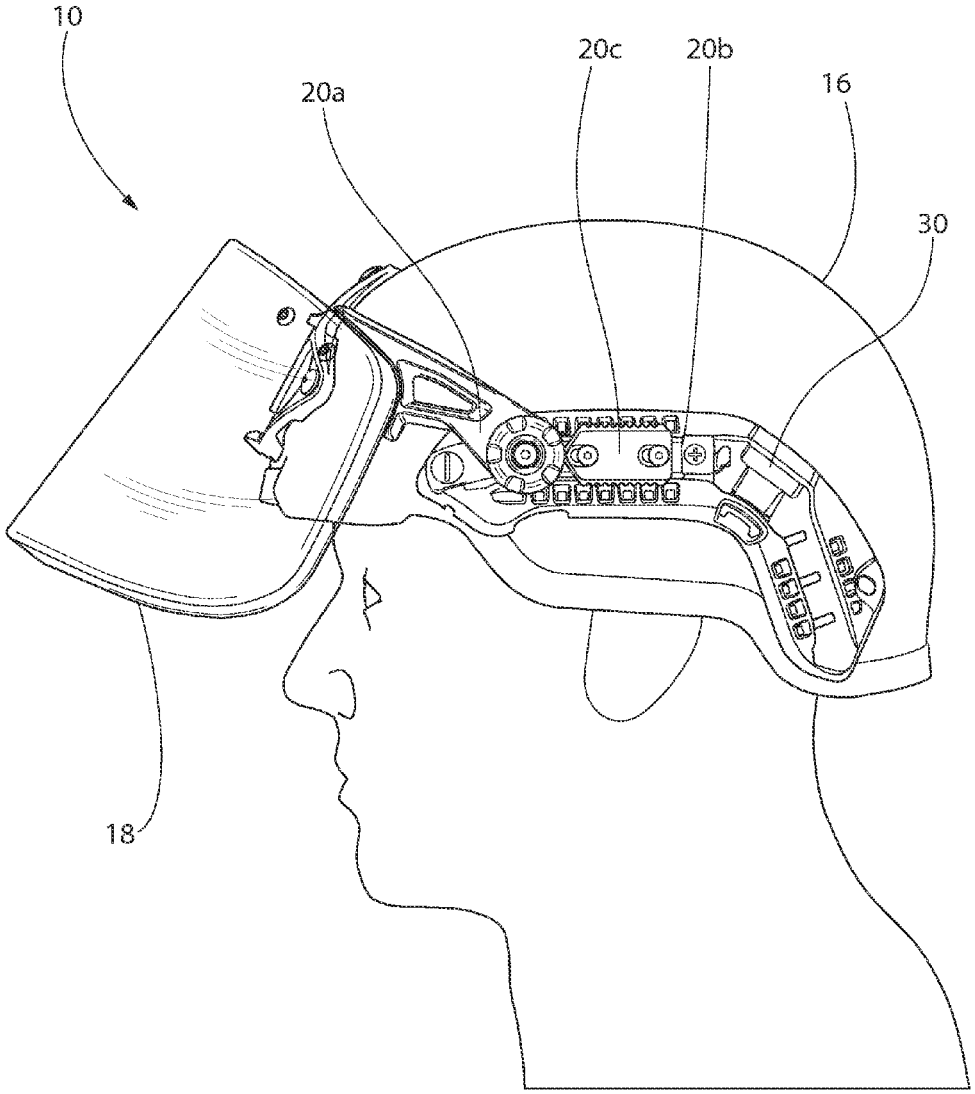
FIG. 7 is a left side view of the helmet mounted visor of FIG. 2 shown mounted to a helmet and in the middle position.
Figure 8:
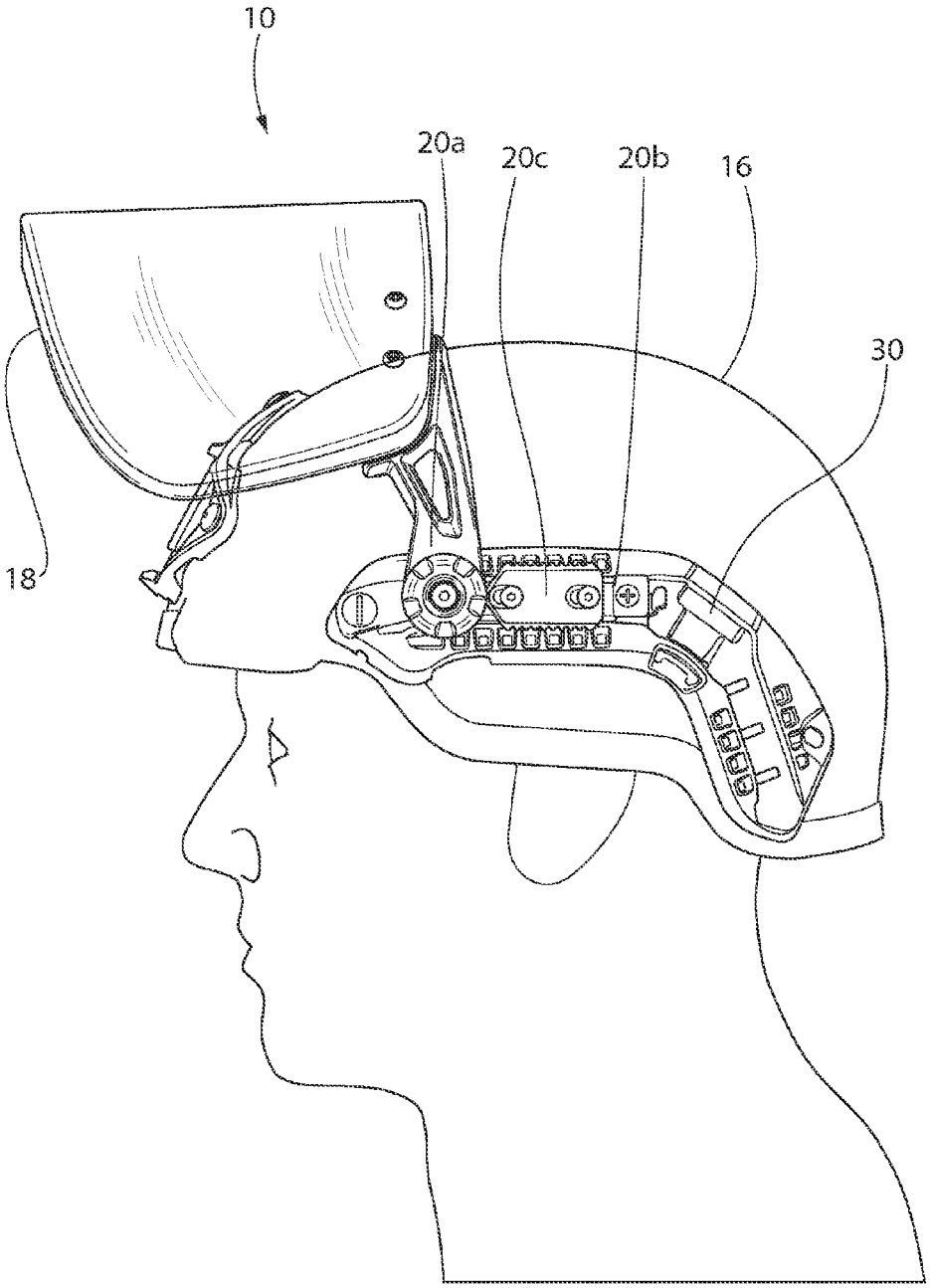
FIG. 8 is a left side view of the helmet mounted visor of FIG. 2 shown mounted to a helmet and in the stowage position.

The helmet mounted visor 10 may include a pair of mount arms 20 coupled to the lens 18 and each configured to releaseably mount to a mount 30 attached to a helmet 16 (see FIG. 2). The pair of mount arms 20 may each include first and second portions 20*a*, 20*b*, where the first portion 20*a* is rotatably coupled to the second portion 20*b* about joint 22. A fastener 24 may extend through the joint 22. The first portion 20*a* may rotate relative to the second portion 20*b* about an axis of the fastener 24. In one embodiment, the first portion 20*a* is configured to be rotated relative to the second portion 20*b* between and held in two or more positions. The two or more positions may include a use position where the lens is positioned in front of the user's face (FIGS. 2 and 4) and a stowage position where the lens is positioned proximate the top of the helmet (FIG. 8). The helmet mounted visor 10 may also include a sighting or middle position where the lens 18 is positioned between the use position and the stowage position (FIG. 7).

Referring to FIG. 3, an end of the first portion 20*a* may be attached to the lens 18 using one or more fasteners 26. In one embodiment, the first portion 20*a* is coupled to a rear surface of the lens 18 and two fasteners 26 extend through the lens 18 to a front surface of the lens 18. The first portion 20*a* may include one or more apertures 28. In one embodiment, the one or more apertures 28 is generally triangular. The one or more apertures 28 may be included to reduce the weight of the first portion 20*a* while maintaining its strength. A second end of the first portion 20*a* may be coupled to the second portion 20*b* by joint 22. Second portion 20*b* may be configured to releaseably attach to a mount 30 (see FIG. 2).

Referring to FIG. 2, in one embodiment, the mount 30 is a rail. In one embodiment, the mount 30 is attached to the helmet 16 using fasteners that extend through existing holes in the helmet 16. In one embodiment, the mount 30 is attached to the helmet 16 using a helmet cover. In one embodiment, the mount 30 extends only partially around the perimeter of the helmet 16. In one embodiment, the mount 30 is configured to attach additional accessories such as lights, communication devices, and mandible shields, to the helmet 16. The mount 30 may be a rail similar to the rails disclosed in U.S. Pat. No. 7,849,517, which is hereby incorporated by reference in its entirety.

Referring to FIG. 3, the second portion 20*b* may include a dove tail shaped projection 32 configured slide into and attach to a corresponding dove tail shaped groove in the mount 30. The second portion 20*b* may be mounted to the mount 30 in one of a plurality of positions along the mount 30 such that the distance between the user's face and the inside surface of the lens 18 is adjustable. In one embodiment, the projection 32 is locked or retained in the groove of the mount 30 by a locking mechanism 34. The locking mechanism 34 may include a leaf spring having a projection 34*a* that is configured to mate with one of a plurality of indentations along the length of the mount 30 and prevents the second portion 20*b* from being slid laterally relative to the mount 30. In one embodiment, pulling a tab 34*b* (see FIG. 5) of the locking mechanism 34 outwardly from the mount 30 releases the locking mechanism 34 (e.g., uncouples the projection 34*a* from an indentation in the mount 30) and allows the second portion 20*b* to be slid along the groove of the mount 30.

In one embodiment, the first and second portions 20*a*, 20*b* are comprised of metal. In one embodiment, the first and second portions 20*a*, 20*b* are comprised of aluminum. The first and second portions 20*a*, 20*b* may be comprised of metal and have a plastic overmold. In other embodiments, the first and second portions 20*a*, 20*b* are comprised entirely of plastic.

Figure 4:
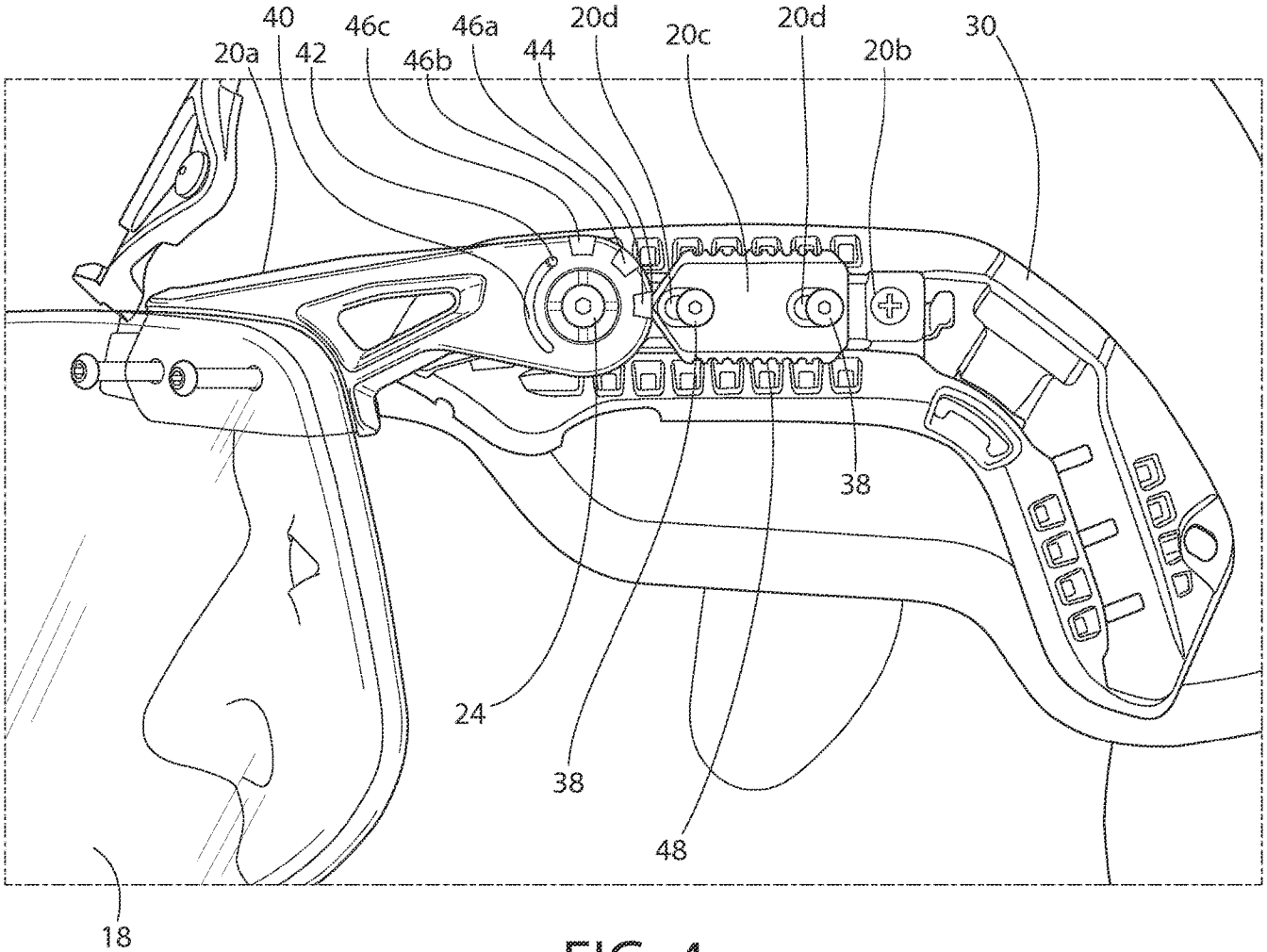
FIG. 4 is a partial left side view of the helmet mounted of FIG. 2 shown mounted to a helmet, in the use position, and with an outer portion of the joint removed for clarity.

Referring to FIG. 4, in one embodiment, at least one of the mount arms 20 includes a locking mechanism 20*c* configured to lock the first portion 20*a* relative to the second portion 20*b*. The locking mechanism 20*c* may be slideably coupled to the second portion 20*b* and spring biased toward the first portion 20*a*. The locking mechanism 20*c* may be coupled to the second portion 20*b* by the fasteners 38 and include corresponding apertures 20*d* that allow for the locking mechanism 20*c* to slide away from the first portion 20*a*. The locking mechanism 20*c* may include a projection 44 that is configured to extend into indentations 46*a*, 46*b*, 46*c* that correspond to the use, middle, and stowage positions of the helmet mounted visor 10 respectively. In one embodiment, the projection 44 extends into the first indentation 46*a* in the use position, into the second indentation 46*b* in the middle position, into the third indentation 46*c* in the stowage position. To unlock the mount arm 20 from the use position for example, the user pulls the locking mechanism 20*c* back away from the first portion 20*a* such that the projection 44 is removed from the first indentation 46*a*, rotates the first portion 20*a* clockwise relative to the second portion 20*b* to the middle position and then releases the locking mechanism 20*c* such that the spring biases the locking mechanism 20*c* toward the first portion 20*a* and the projection is inserted into the second indentation 46*b* preventing further movement of the first portion 20*a* relative to the second portion 20*b*.

The first portion 20*a* may include a slot 40 that receives a pin 42 extending from the second portion 20*b*. The slot 40 and pin 42 may be configured to prevent the first portion 20*a* from rotating relative to the second portion 20*b* past predetermined limit angles or positions (e.g., between parallel and perpendicular). The locking mechanism 20*c* may include a plurality of ridges 48 to provide enhanced grip with the user's hand or thumb while releasing the locking mechanism 20*c*.

Figure 5:
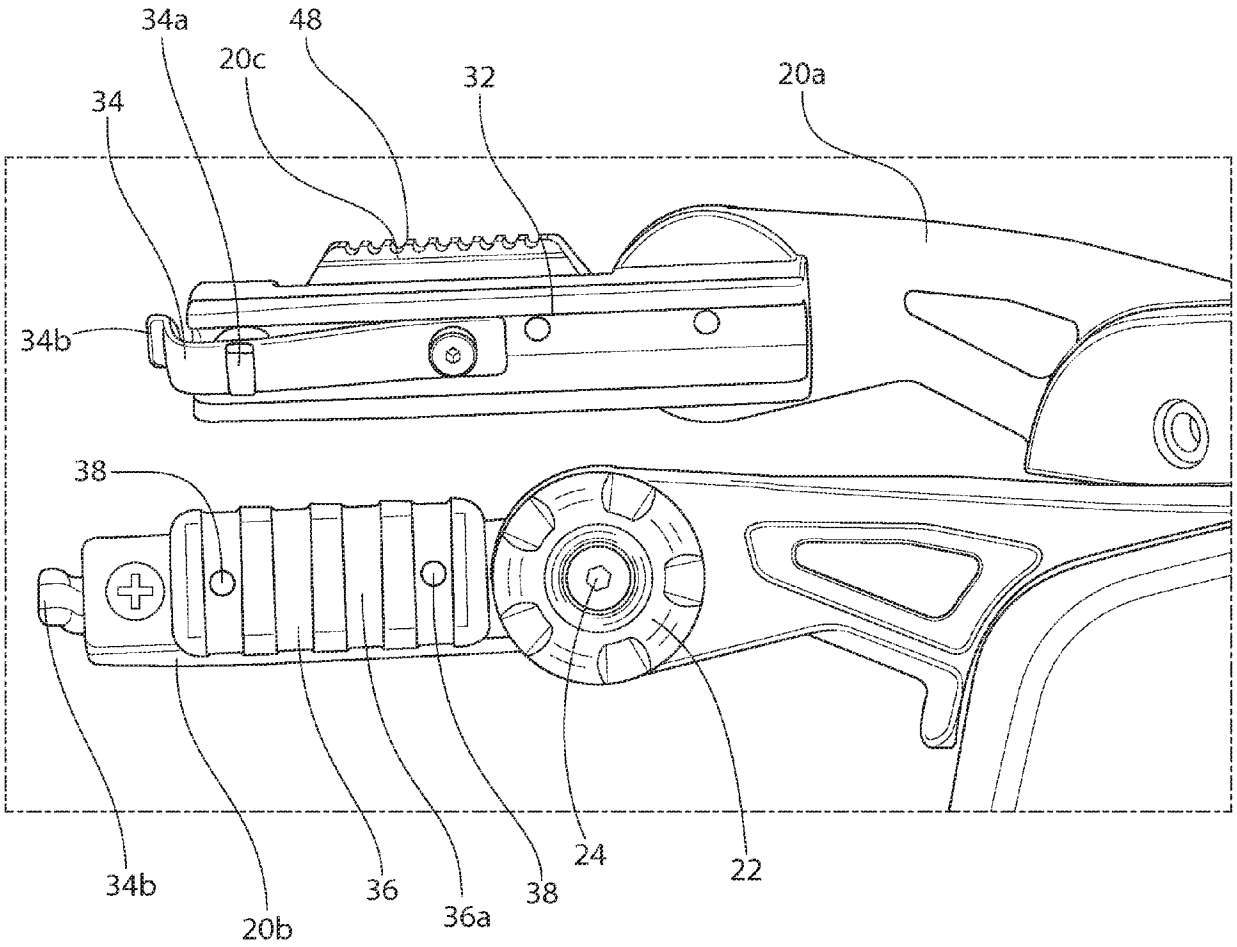
FIG. 5 is a right side view of the helmet mounted visor of FIG. 2 shown in the use position.

Referring to FIG. 5, the second portion 20*b* may include an additional mount portion 36. The mount portion 36 may be attached to the second portion 20*b* with one or more fasteners 38. The mount portion 36 may include one or more features 36*a* such as grooves and/or projections that allow for additional accessories to be attached to the second portion 20*b*. In one embodiment, the one or more features 36*a* include a plurality of vertical grooves and ridges. In one embodiment, the mount portion 36 includes a portion of a Picatinny rail.

Figure 6:
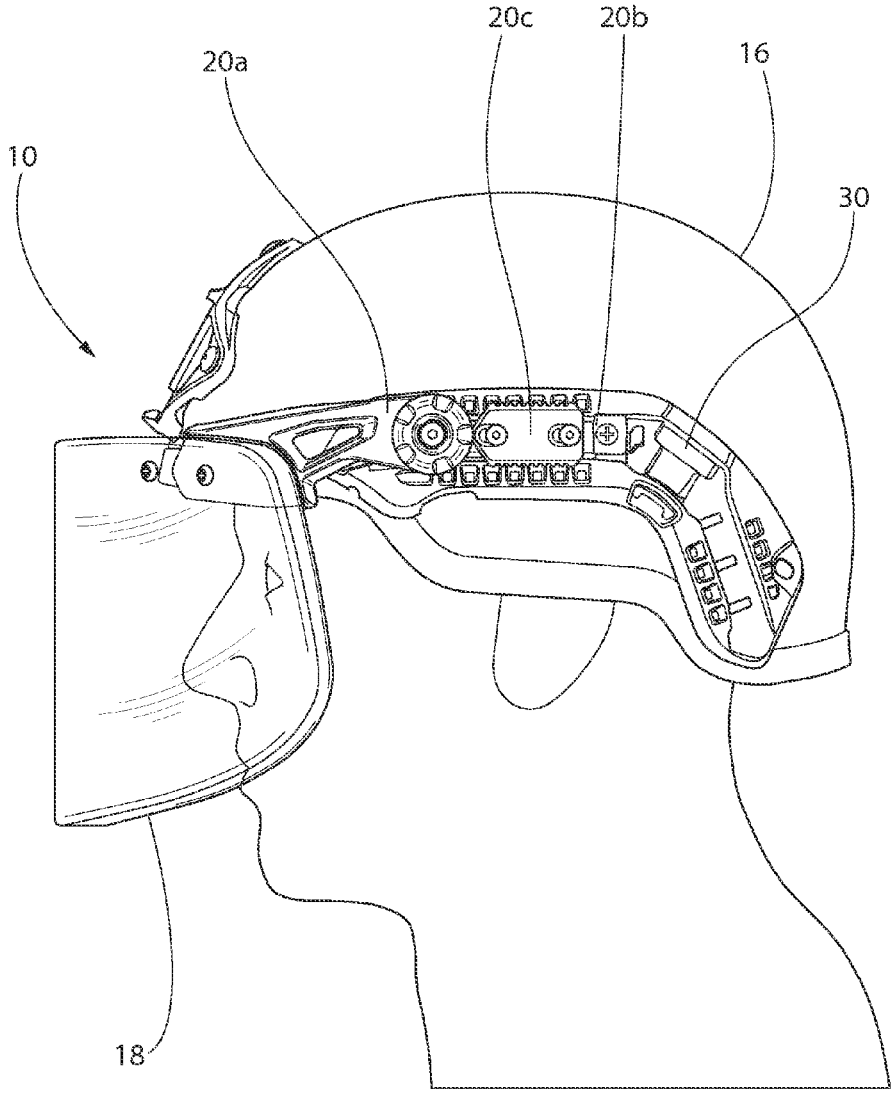
FIG. 6 is a left side view of the helmet mounted visor of FIG. 2 shown mounted to a helmet and in the use position.

Referring to FIG. 6, the helmet 16 may be any type of head protection helmet known in the art, for example, those used for sporting, police, or military purposes. In certain embodiments, helmet 16 is a standard infantry ballistic helmet. In some embodiments, helmet 16 is an advanced combat helmet (ACH), a modular integrated communications helmet (MICH), a tactical ballistic helmet (TBH) II helmet, a lightweight marine helmet, a personnel armor system for ground troops (PASGT) helmet or police general duty helmets.

In some embodiments, by using mount arms 20*a*, 20*b* to attach the lens 18 to a mount 30 rather than using a halo system increases stability, reduces bulk, allows for usage with different helmets, and allows for the mounts 30 to remain on the helmet. In addition, a significant weight savings may be achieved. A traditional 9 mm visor kit such as the one shown in FIG. 1 weighs approximately 1,464 grams. While, in some embodiments, the helmet mounted visor 10 weighs less than approximately 1,264 grams. In addition, the helmet mounted visor 10 may be operated with one hand to adjust the lens from a fully closed or use position, to a fully open or stowage position to a middle position.

FIG. 6 shows the helmet mounted visor 10 in the use position from a side view. In one embodiment, the first portion 20*a* is generally parallel to the second portion 20*b* in the use position. As the locking mechanism 20*c* is moved to the aft position with the user's thumb, the lens 18 can pivot up as shown in FIGS. 7 and 8. Releasing the locking mechanism 20*c* and pivoting the lens 18 can be accomplished with one hand of the user. The thumb of the user pushes back on the release mechanism 20*c* in the aft direction while the fingers or palm of the hand pivot up the lens 18 relative to the second portion 20*b*.

FIG. 7 shows the helmet mounted visor 10 in the middle position. In one embodiment, the first portion 20*a* is approximately 45 degrees relative to the second portion 20*b* in the middle position. Pivoting up the lens 18 into the middle position may allow the user to partially expose their face and provide partial protection while clearing the lens 18 from moisture or dirt on the inside surface, sighting a weapon, communicating more clearly, donning or doffing a gas mask to the user's face, or accessing food or drink.

FIG. 8 shows the helmet mounted visor 10 in the fully upright or stowage position. In one embodiment, the first portion 20*a* is approximately perpendicular to the second portion 20*b* in the stowage position. Pivoting up the lens 18 into the stowage position may allow the user to substantially expose their face when the lens 18 is no longer needed but not ready to detach the helmet mounted visor 10 from the helmet 16. Pivoting the lens 18 to the stowage position allows the user to remove the lens 18 from their field of vision while allowing the lens 18 to be quickly deployed to the use position.

Once pivoted to the desired position, the helmet mounted visor 10 may remain locked in the use, stowage or middle positions such that the first portion 20*a* does not move relative to the second portion 20*b* until the locking mechanism 20*c* is released.

Referring to the drawings in detail, wherein like reference numerals indicate like elements throughout, there is shown in FIGS. 9-16 a helmet mounted visor, generally designated 110, in accordance with a second exemplary embodiment of the present invention. One or more of the embodiments discussed in reference to the helmet mounted visor 110 described below may be combined with one or more desirable features of the embodiments discussed in reference to the helmet mounted visor 10 described above.

Figure 9:
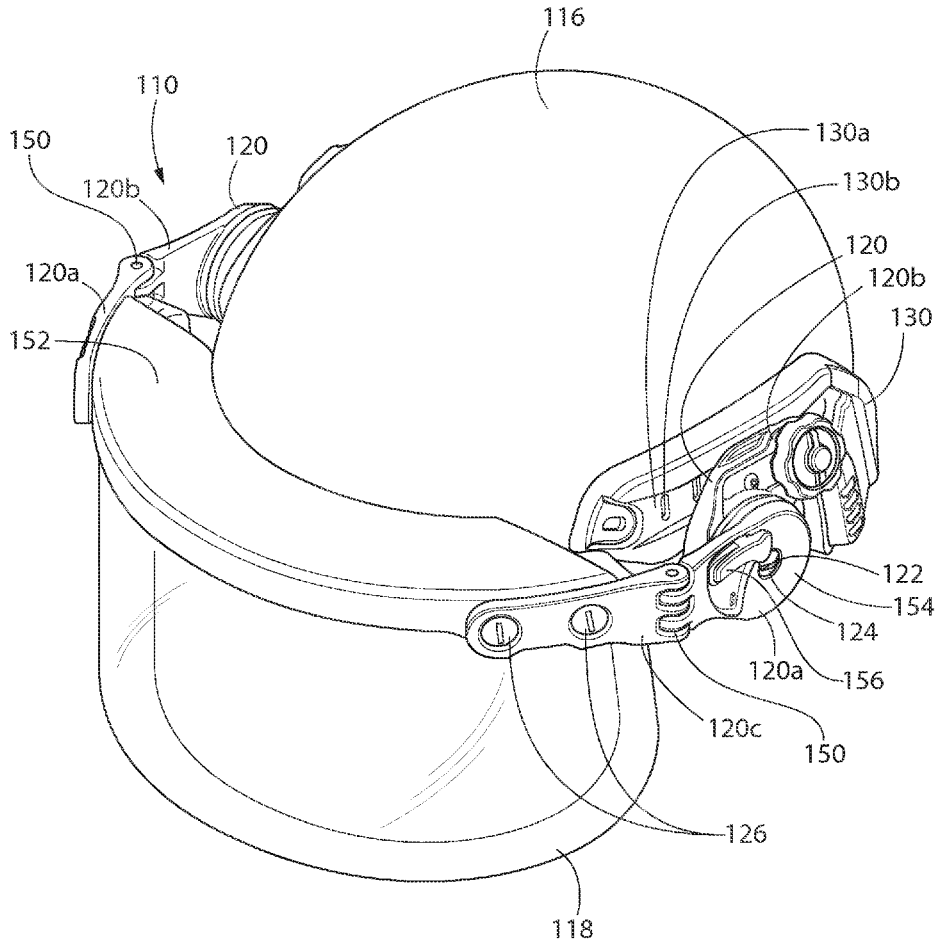
FIG. 9 is a perspective view of a helmet mounted visor in accordance with an exemplary embodiment of the present invention shown mounted to a helmet and in the use position.
Figure 10:
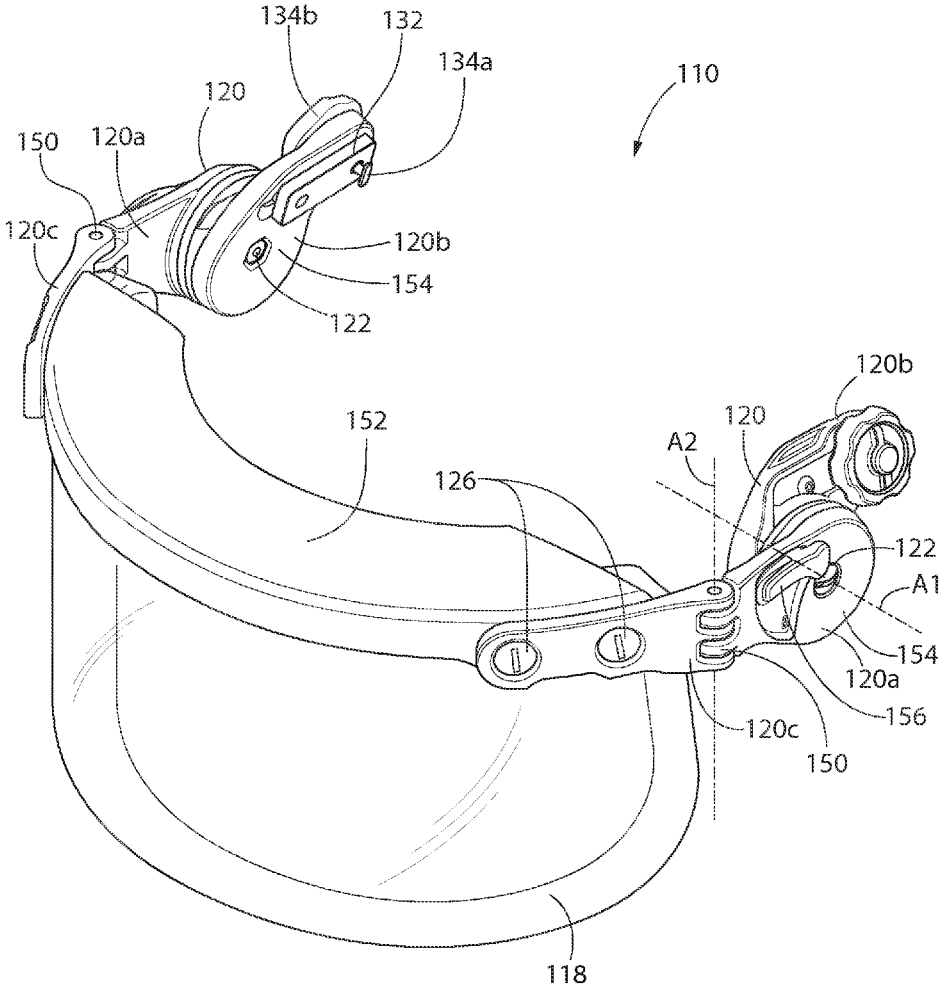
FIG. 10 is a perspective view of the helmet mounted visor shown in FIG. 9.

Referring to FIGS. 9 and 10, the helmet mounted visor 110 includes a lens 118. In one embodiment, the lens 118 is configured to extend across substantially all of a user's face. In one embodiment, the lens 18 is curved to extend across the front and sides of the user's face. The lens 118 may be transparent. In other embodiments, the lens 118 has a tint. The lens 118 may be frameless. In other embodiments, the lens 118 may include a frame extending around at least a portion of the outer periphery. In one embodiment, the lens 118 is approximately 28 mm thick, 280 mm wide and 127 mm high. In one embodiment, the lens 118 is approximately 150 mm or approximately 178 mm high. In one embodiment, the lens 118 is comprised of a ballistic material such as a polycarbonate substrate with an acrylic laminate.

Figure 15:
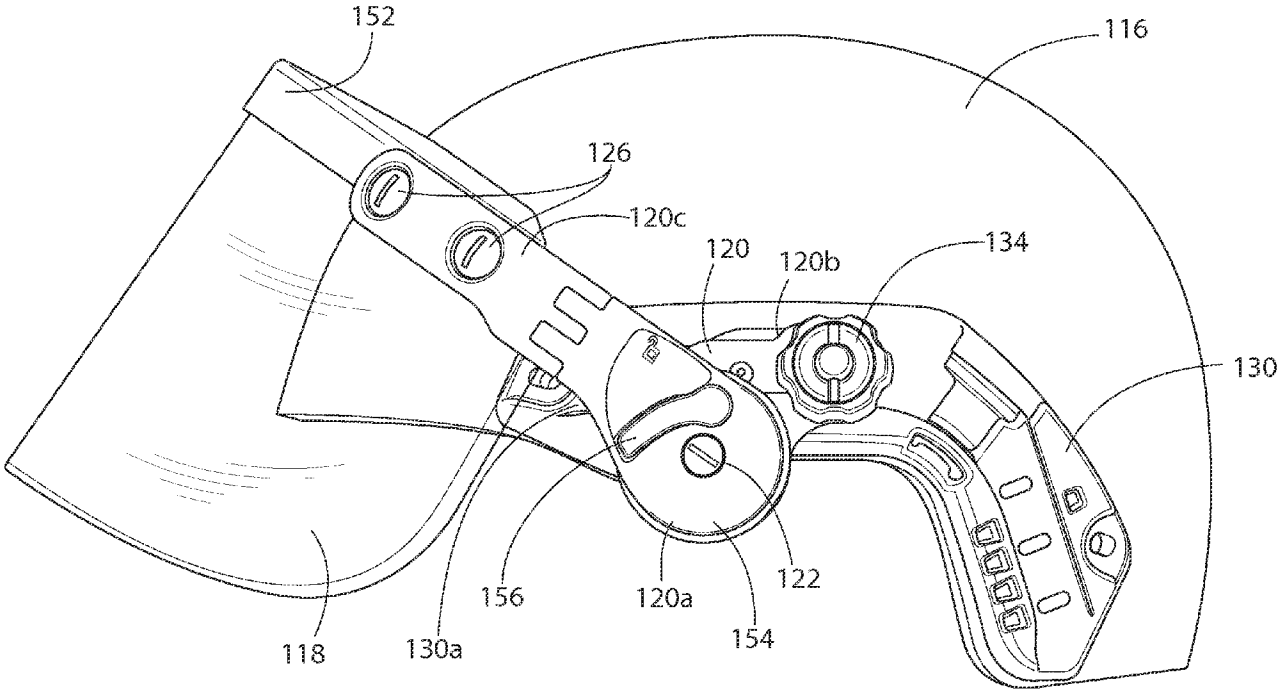
FIG. 15 is a left side view of the helmet mounted visor of FIG. 9 shown mounted to a helmet and locked in the middle position.
Figure 16:
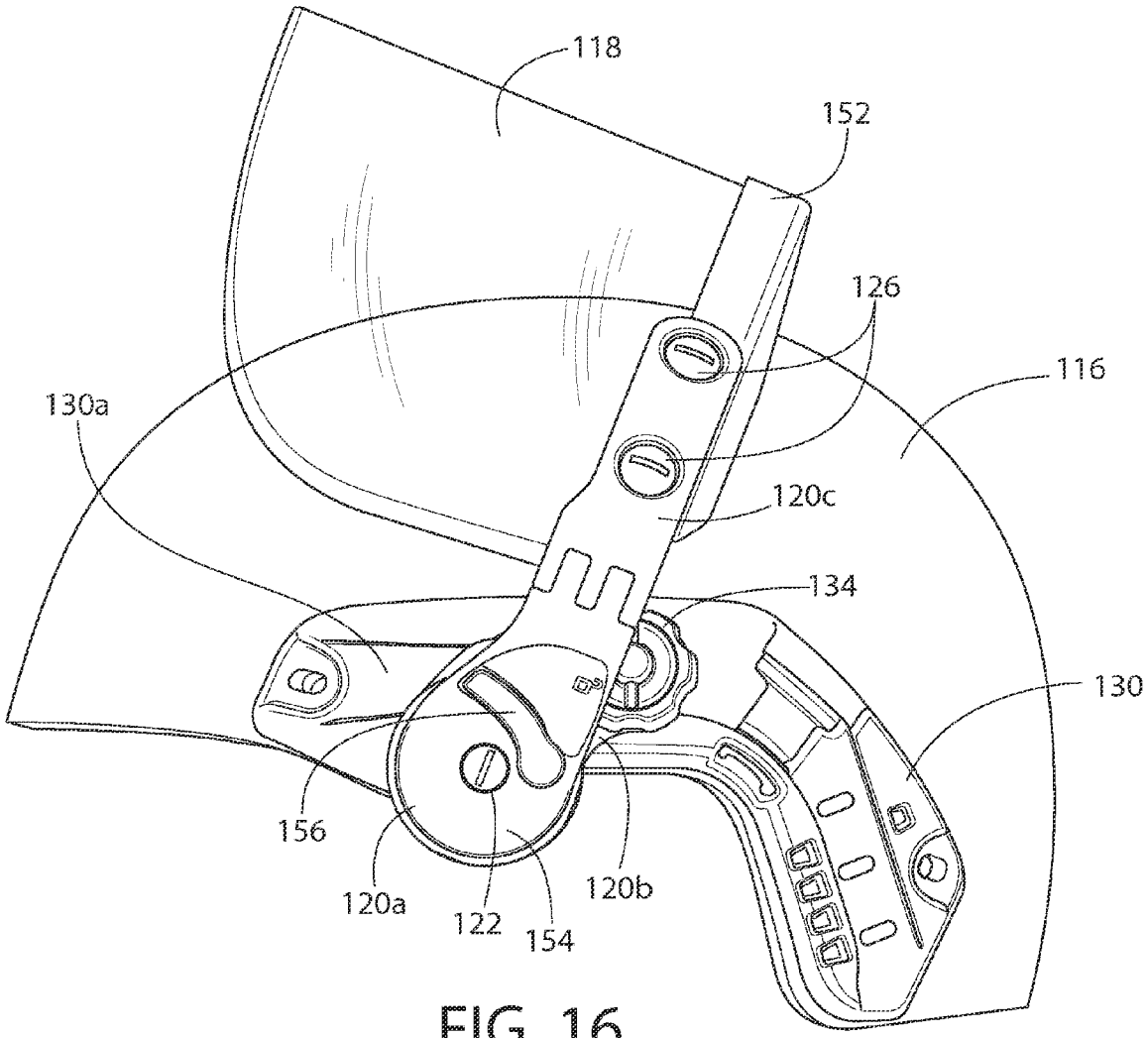
FIG. 16 is a left side view of the helmet mounted visor of FIG. 2 shown mounted to a helmet and locked in the stowage position.

The helmet mounted visor 110 may include a pair of mount arms 120 coupled to the lens 118 and each configured to releaseably mount to a mount 130 attached to a helmet 116 (see FIG. 9). The pair of mount arms 120 may each include first, second, and third portions 120*a*, 120*b*, 120*c*, where the first portion 120*a* is rotatably coupled to the second portion 120*b* about joint 122. A fastener 124 may extend through the joint 122. The first portion 120*a* may rotate relative to the second portion 120*b* about an axis $A_1$ of the fastener 124. In one embodiment, axis $A_1$ is generally parallel to a plane extending through mount arms 120. In one embodiment, the first portion 120*a* is configured to be rotated relative to the second portion 120*b* between and held in two or more positions. The two or more positions may include a use position where the lens 118 is positioned in front of the user's face (FIGS. 9 and 14) and a stowage position where the lens 118 is positioned proximate the top of the helmet 116 (FIG. 16). The helmet mounted visor 110 may also include a sighting or middle position where the lens 118 is positioned between the use position and the stowage position (FIG. 15).

The mount arms 120 may be laterally rotatable relative to the lens 18. The mount arms 120 may be rotatable relative to the lens 18 similar to eyeglasses so that the helmet mounted visor 110 may be used with a variety of different sized helmets 116 and/or the mount arms 120 may be folded inwardly when not mounted to the helmet 116 to reduce the overall size of the helmet mounted visor 110. In one embodiment, the first portion 120*a* is rotatably coupled to a third portion 120*c* mounted to the lens 18. The first portion 120*a* may be coupled to the third portion 120*c* by a hinge 150 having an axis $A_2$. In one embodiment, the axis $A_2$ of the hinge 150 may be generally perpendicular to the axis $A_1$ of the fastener 124.

An end of the third portion 120*c* may be attached to the lens 118 using one or more fasteners 126. In one embodiment, the third portion 120*c* is coupled to a front surface of the lens 118 and two fasteners 126 extend through the lens 118 to a rear surface of the lens 118. A flange 152 may be provided on the top of the lens 118 that extends back toward the second portions 120*b*. The flange 152 may be configured to extend from the top of the lens 118 to the external surface of the helmet 116 to prevent debris from going between the user's face and the inside surface of the lens 118. In one embodiment, the flange 152 has an outer edge that is curved to generally match the contour of the outer surface of the lens 118 and an inner edge that is curved to generally match the contour of the external surface of the helmet 116. In one embodiment, a portion of the flange 152 wraps around the top edge of the lens 118 and is sandwiched between the ends of the third portion 120*c* and the outside surface of the lens 118 to fasten the flange 152 to the lens 118.

Referring to FIG. 9, in one embodiment, the mount 130 is a rail. In one embodiment, the mount 130 is attached to the helmet 116 using fasteners that extend through existing holes in the helmet 116. In one embodiment, the mount 130 is attached to the helmet 116 using a helmet cover. In one embodiment, the mount 130 extends only partially around the perimeter of the helmet 116. In one embodiment, the mount 130 is configured to attach additional accessories such as lights, communication devices, and mandible shields, to the helmet 116. The mount 130 may be a rail similar to the rails disclosed in U.S. Pat. No. 7,849,517, which is hereby incorporated by reference in its entirety.

Figure 11:
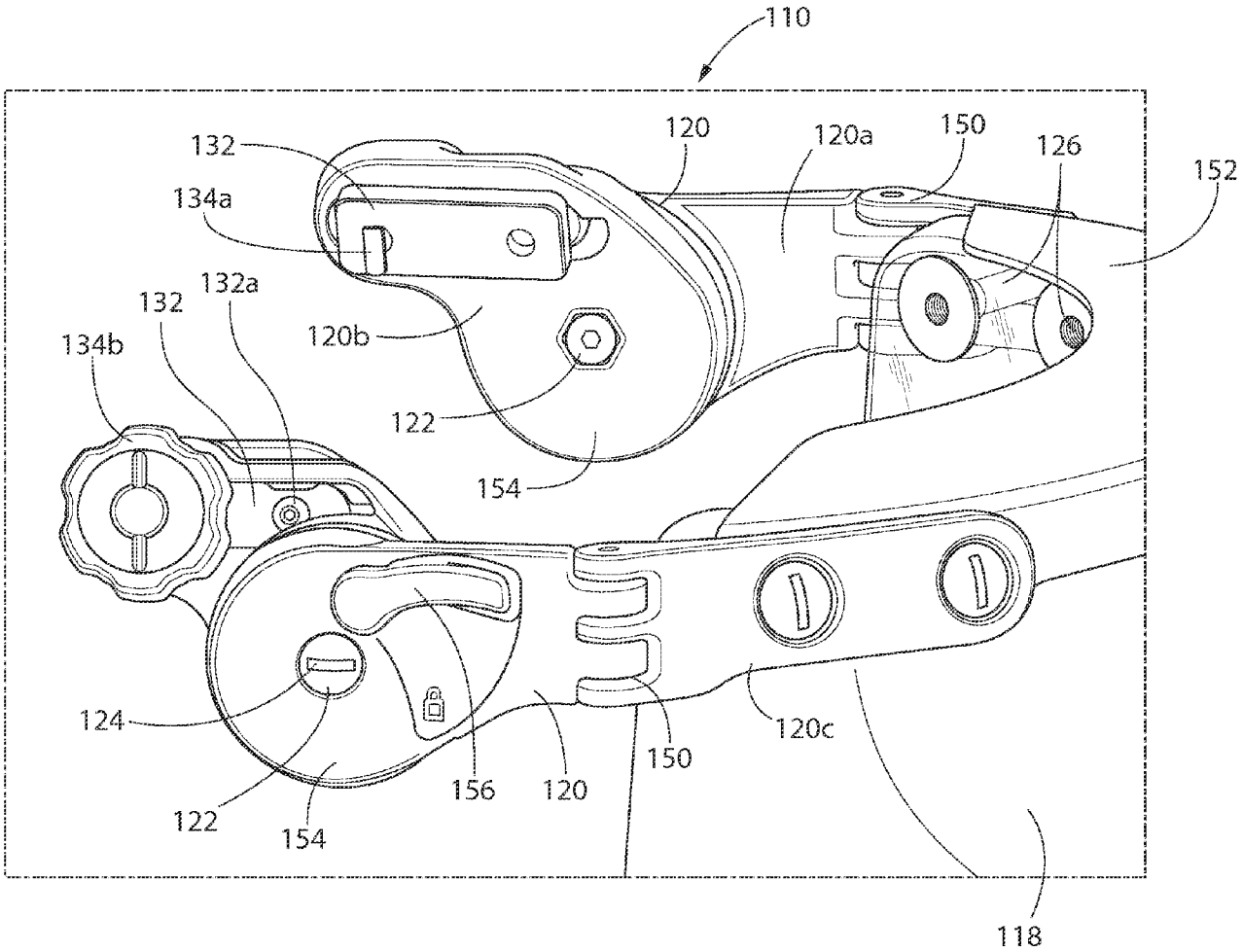
FIG. 11 is a right side view of the mount arms of helmet mounted visor of FIG. 9 shown in the use position.

Referring to FIG. 11, the second portion 120*b* may include a projection 132 configured to extend into the groove 130*a* in the mount 130. In one embodiment the projection 132 is rectangular shaped. In another embodiment, the projection 132 is dove tail shaped. The second portion 120*b* may be mounted to the mount 130 in one of a plurality of positions along the mount 130 such that the distance between the user's face and the inside surface of the lens 118 is adjustable. In one embodiment, the projection 132 is adjustable toward and away from the lens 118 relative to the mount arm 120 to provide fine tuning of the distance between the user's face and the inside surface of the lens 118. The projection 132 may be locked in place relative to the mount arm 120 by a fastener 132*a*. In one embodiment, the projection 132 is locked or retained in the groove 130*a* of the mount 130 by a locking mechanism 134. The locking mechanism 134 may include a knob 134*b* having an extension arm 134*a* that is configured to mate with one of a plurality of indentations 130*b* along the length of the mount 130 and prevent the second portion 120*b* from detaching from the mount 130. The extension arm 134*a* may be generally rectangular in shape. In one embodiment, the extension arm 134*a* extends into an indentation 130*b* and then the knob 134*b* is rotated to rotate the extension arm 134*a* 90 degrees. In one embodiment, twisting the knob 134*b* also pulls the extension arm 134*a* closer to the projection 132 to sandwich the rail 130 between the extension arm 134*a* and the projection 132. In one embodiment, twisting the knob 134*b* of the locking mechanism 134 in the opposite direction releases the locking mechanism 134 (e.g., uncouples the extension arm 134*a* from an indentation in the mount 130) and allows the second portion 120*b* to be removed from the mount 130.

In one embodiment, the first, second, and third portions 120*a*, 120*b*, 120*c* are comprised of metal. In one embodiment, the first, second, and third portions 120*a*, 120*b*, 120*c* are comprised of aluminum. The first, second, and third portions 120*a*, 120*b*, 120*c* may be comprised of metal and have a plastic overmold. In other embodiments, the first, second, and third portions 120*a*, 120*b* are comprised entirely of plastic.

Figure 12:
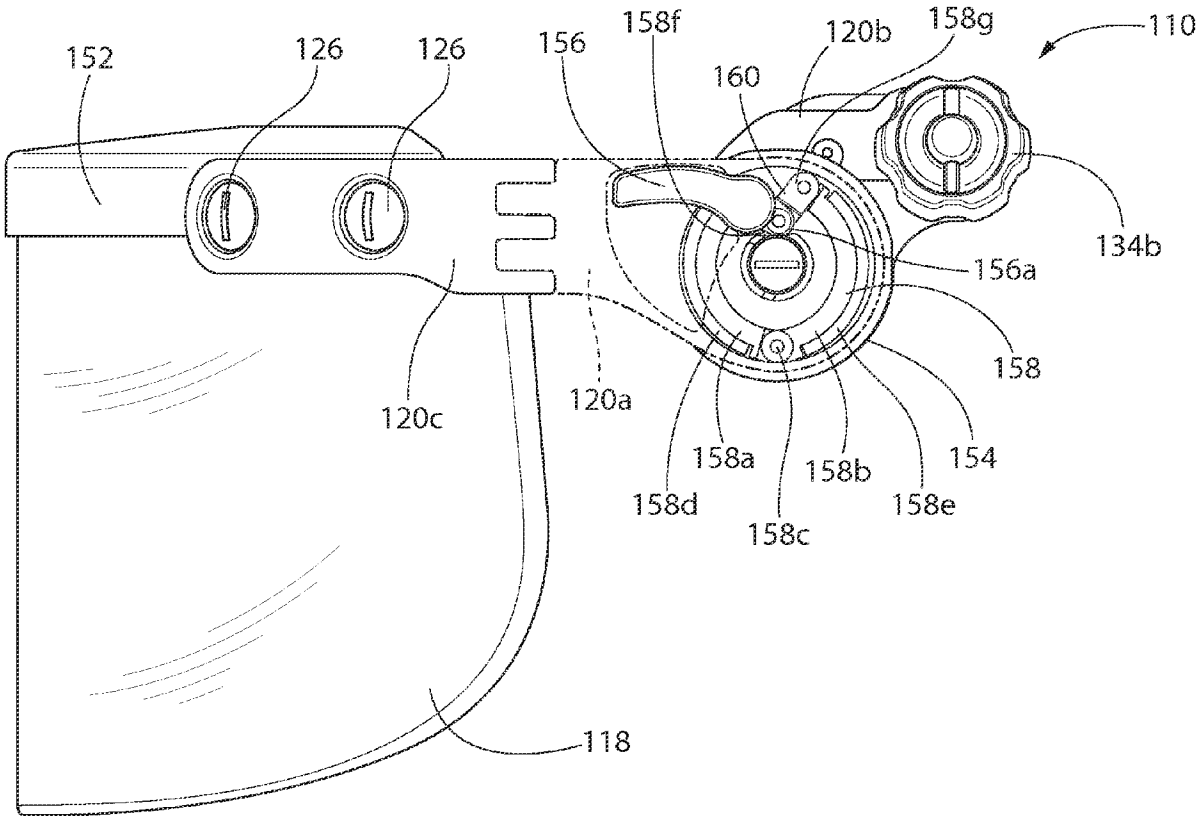
FIG. 12 is a partial left side view of the helmet mounted visor of FIG. 9 shown with an outer portion of the joint removed showing the lock in the unlocked position.
Figure 13:
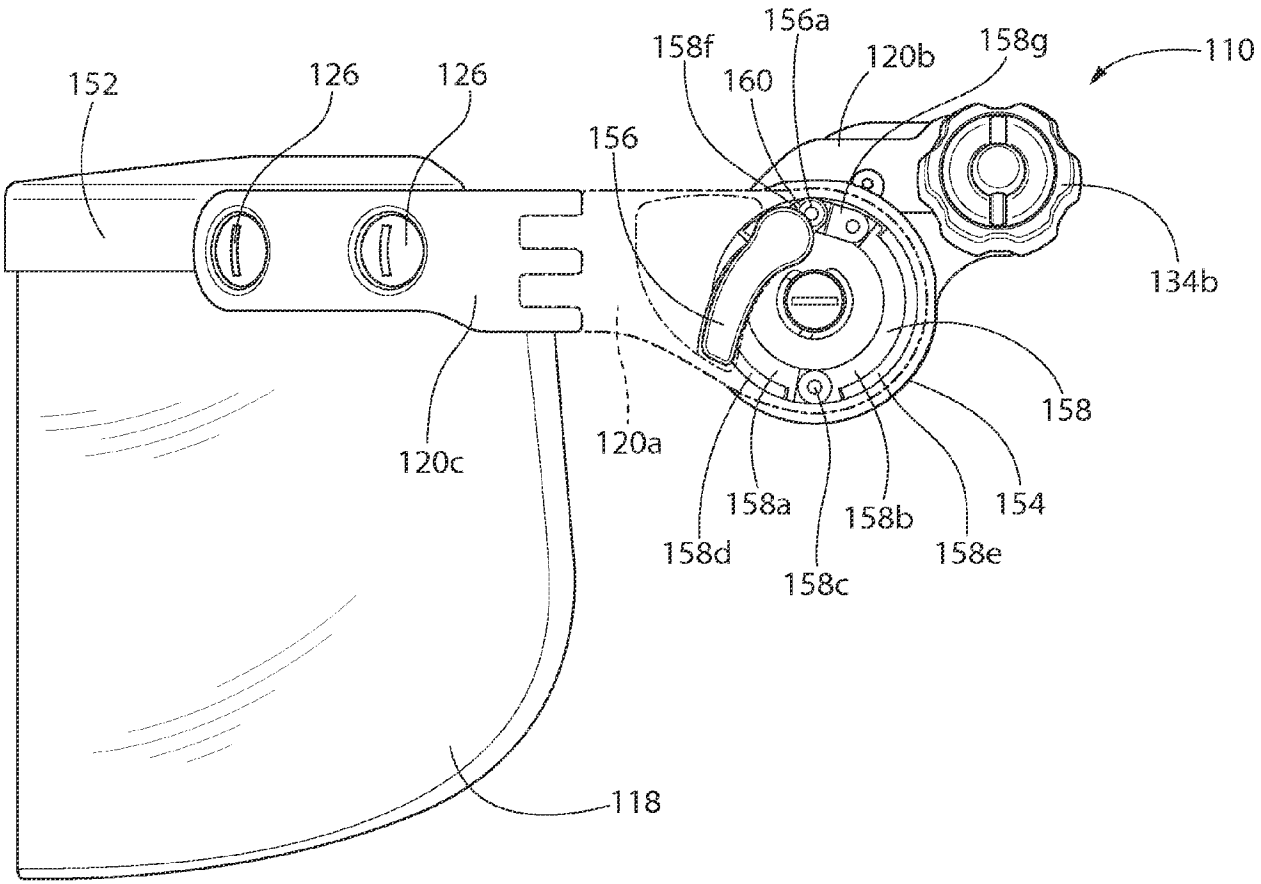
FIG. 13 is a partial left side view of the helmet mounted visor of FIG. 9 shown with an outer portion of the joint removed showing the lock in the locked position.

Referring to FIGS. 12 and 13, in one embodiment, at least one of the mount arms 120 includes a locking mechanism 154 configured to lock the first portion 120*a* relative to the second portion 120*b*. The locking mechanism 154 may selectively lock the first portion 120*a* relative to the second portion 120*b* in the use position, the stowage position, and any desired middle position between the use and stowage positions. The helmet mounted visor 110 may include one locking mechanism on either side (e.g., on one mount arm 120 or the other) or a locking mechanism 154 on both sides as shown. The locking mechanism 154 may include a drum brake 158. In one embodiment, the drum brake 158 includes a first shoe 158*a* rotatably coupled to a second shoe 158*b* about a pin 158*c*. The first and second shoes 158*a*, 158*b* may each include a brake pad 158*d*, 158*e*. The first and second shoes 158*a*, 158*b* may be coupled by an actuator 160 such as a weak knee joint. The weak knee joint may include two linkages 158*f*, 158*g* that are pivotably connected between the first and second shoes 158*a*, 158*b*. In the unlocked position (see e.g., FIG. 12), the drum brake 158 is not engaged and the first portion 120*a* is free to move relative to the second portion 120*b*. In the locked position (see e.g., FIG. 13), the brake pads 158*d*, 158*e* may be frictionally engaged with the inside surface of the housing 154*a* of the locking mechanism 154 to prevent or at least strongly resist the first portion 120*a* being moveable relative to the second portion 120*b*. A lever 156 may be provided for engaging and disengaging the locking mechanism 154. The lever 156 may include an arm 156*a* that is coupled to the linkages 158*f*, 158*g*. In one embodiment, pulling the lever 156 downwardly pivots the linkages 158*f*, 158*g* upwardly and into the locked position. In one embodiment, pushing the lever 156 upwardly pivots the linkages 158*f*, 158*g* downwardly and into the unlocked position. The locking mechanism 154 may include one or more limiters, such as a set screw, that is configured to prevent the drum brake 158 from rotating past the use and/or stowage positions.

Figure 14:
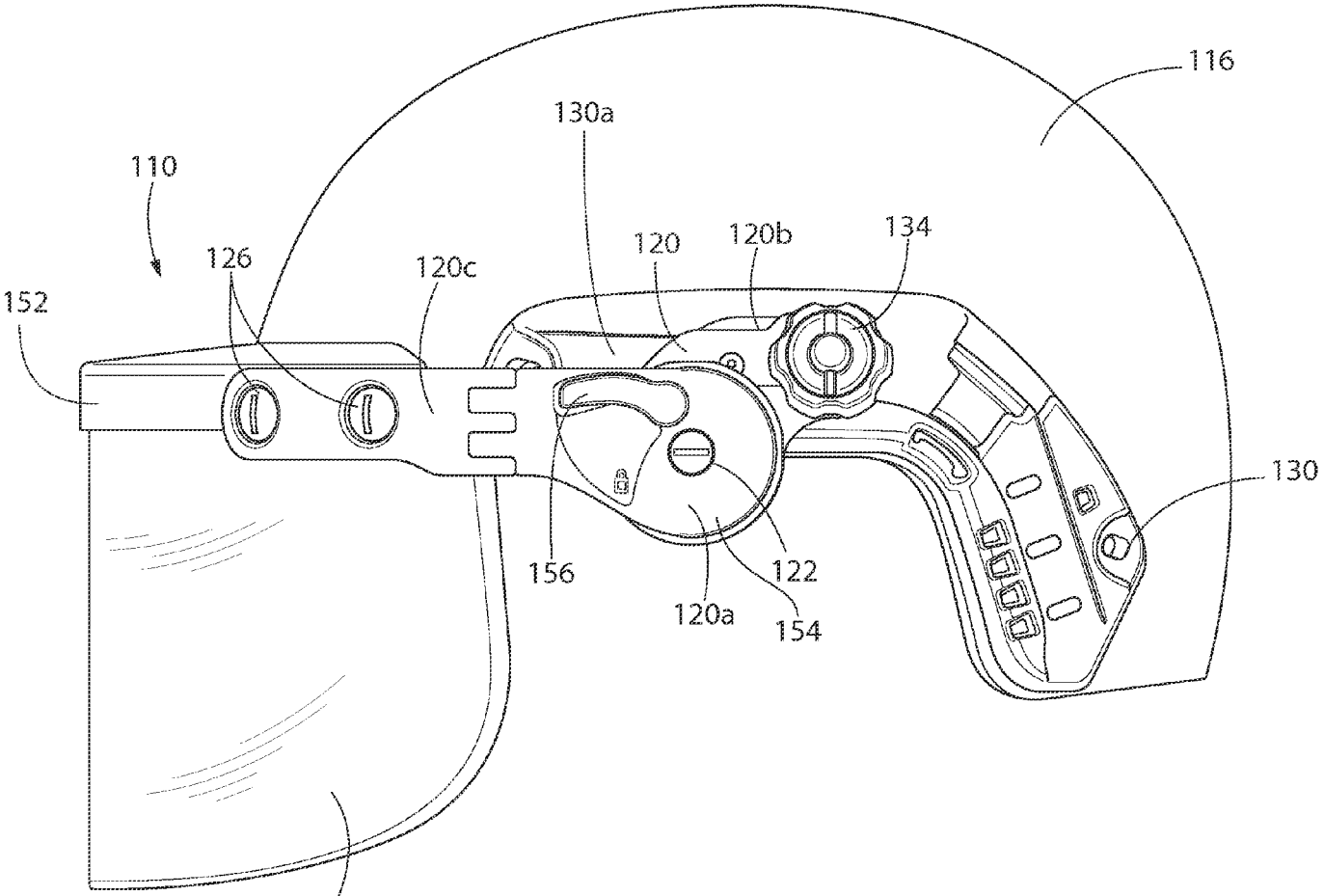
FIG. 14 is a left side view of the helmet mounted visor of FIG. 9 shown mounted to a helmet and in the use position.

Referring to FIG. 14, the helmet 116 may be any type of head protection helmet known in the art, for example, those used for sporting, police, or military purposes. In certain embodiments, helmet 116 is a standard infantry ballistic helmet. In some embodiments, helmet 116 is an advanced combat helmet (ACH), a modular integrated communications helmet (MICH), a tactical ballistic helmet (TBH) II helmet, a lightweight marine helmet, a personnel armor system for ground troops (PASGT) helmet or police general duty helmets.

In some embodiments, by using mount arms 120*a*, 120*b* to attach the lens 118 to a mount 130 rather than using a halo system increases stability, reduces bulk, allows for usage with different helmets, and allows for the mounts 130 to remain on the helmet 116. In addition, the helmet mounted visor 110 may be operated with one hand to adjust the lens from a fully closed or use position, to a fully open or stowage position to a middle position.

FIG. 14 shows the helmet mounted visor 110 in the use position from a side view. In one embodiment, the first portion 120*a* is generally parallel to the second portion 120*b* (or the groove 130*a* of the rail 130) in the use position. After the locking mechanism(s) 154 is unlocked by pulling up on the lever 156, the lens 118 can pivot up as shown in FIGS. 15 and 16. Releasing the locking mechanism 154 and pivoting the lens 118 can be accomplished with one hand of the user. The thumb of one hand of the user pushes up on the lever 156 and then the fingers or palm of the hand may then pivot up the lens 118 relative to the second portion 120*b*.

FIG. 15 shows the helmet mounted visor 110 in the middle position. In one embodiment, the first portion 120*a* is approximately 45 degrees relative to the second portion 120*b* (or the groove 130*a* of the rail 130) in the middle position. Pivoting up the lens 118 into the middle position may allow the user to partially expose their face to clear the lens 118 from moisture or dirt on the inside surface, communicate more clearly, don or doff a gas mask to the user's face, or access food or drink.

FIG. 16 shows the helmet mounted visor 110 in the fully upright or stowage position. In one embodiment, the first portion 120*a* is approximately 80 degrees to the second portion 20*b* (or the groove 130*a* of the rail 130) in the stowage position. Pivoting up the lens 118 into the stowage position may allow the user to substantially expose their face when the lens 118 is no longer needed but not ready to detach the helmet mounted visor 110 from the helmet 116. Pivoting the lens 118 to the stowage position may allow the user to remove the lens 118 from their field of vision while allowing the lens 118 to be quickly deployed to the use position.

Once pivoted to the desired position, the helmet mounted visor 110 may remain locked in the use, stowage or middle positions such that the first portion 120*a* does not move relative to the second portion 120*b* until the locking mechanism 154 is released.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

We claim:

1. A helmet mounted visor comprising:

a lens configured to extend across substantially all of a user's face; and a pair of mount arms coupled to the lens, each mount arm being configured to releaseably mount to a mount attached to a helmet, wherein the pair of mount arms each include a projection configured to attach to a groove in the mount in a plurality of positions along the groove.

2. The helmet mounted visor of claim 1, wherein the pair of mount arms each include first and second portions, the first portion being rotatably coupled to the second portion.

3. The helmet mounted visor of claim 2, wherein the first portion is configured to be rotated between and held in two or more positions relative to the second portion.

4. The helmet mounted visor of claim 3, wherein the two or more positions include a use position where the lens is positioned in front of the user's face and a stowage position where the lens is positioned over a top surface of the helmet.

5. The helmet mounted visor of claim 4, wherein the two or more positions include a middle position where the lens is positioned between the use position and the stowage position.

6. The helmet mounted visor of claim 2, wherein at least one of the pair of mount arms includes a locking mechanism configured to lock the first portion relative to the second portion.

7. The helmet mounted visor of claim 6, wherein the locking mechanism includes a drum brake.

8. The helmet mounted visor of claim 7, wherein the locking mechanism includes a lever configured to selectively lock and release the drum brake.

9. The helmet mounted visor of claim 3, wherein the first portion is rotatable relative to the second portion about a first axis and the pair of mount arms each include a third portion, the first portion being rotatably coupled to the third portion about a second axis, the second axis being generally perpendicular to the first axis.

10. The helmet mounted visor of claim 1, wherein the mount is a rail.

11. The helmet mounted visor of claim 10, wherein the rail is attached to the helmet using fasteners that extend through existing holes in the helmet.

12. The helmet mounted visor of claim 1, wherein a position of the projections is adjustable relative to the pair of mount arms.

13. The helmet mounted visor of claim 1, wherein the lens has a thickness of at least approximately 28 mm.

14. The helmet mounted visor of claim 1, wherein the lens has a height of at least approximately 127 mm.

15. The helmet mounted visor of claim 1, wherein the pair of mount arms are configured to mount to the helmet to position the lens at a plurality of distances from the user's face.

16. The helmet mounted visor of claim 1 further comprising: a flange mounted to the top of the lens and extending toward the pair of mount arms.

17. A helmet mounted visor comprising:

a lens;

a pair of mount arms coupled to the lens, each mount arm configured to releaseably mount to a mount attached to a helmet and including a projection configured to attach to a groove in the mount in a plurality of positions along the groove, the pair of mount arms each including first, second and third portions, the first portion being rotatably coupled to the second portion about a first axis, the first portion being rotatably coupled to the third portion about a second axis, the second axis being generally perpendicular to the first axis; and a locking mechanism configured to selectively retain the first portion relative to the second portion in and between a use position where the lens is positioned in front of a user's face and a stowage position where the lens is positioned proximate a top of the helmet.

18. A helmet mounted visor comprising:

a lens configured to extend across substantially all of a user's face;

a pair of mount arms coupled to the lens, each mount arm being configured to releaseably mount to a mount attached to a helmet; and a flange mounted to the top of the lens and extending toward the pair of mount arms.

* * * * *